US005943298A

United States Patent [19]

Goldson

[11] Patent Number: 5,943,298

[45] Date of Patent: Aug. 24, 1999

[54] MULTI-DIMENSIONAL CALENDAR

[76] Inventor: Flavia Goldson, 170-22 130th Ave., Apt. 5F, Jamaica, N.Y. 11434-3236

[21] Appl. No.: 08/842,729

[22] Filed: Apr. 16, 1997

[51] Int. Cl.[6] ..... G04B 19/22

[52] U.S. Cl. ..... 368/27; 40/115; 40/113; 368/28

[58] Field of Search ..... 368/10, 27, 28; 40/115, 113

[56] References Cited

U.S. PATENT DOCUMENTS 5,177,712 1/1993 Kakizawa ..... 368/28
5,732,490 3/1998 Hydary ..... 40/115

*Primary Examiner*—Bernard Roskoski
*Attorney, Agent, or Firm*—Michael I. Kroll

[57] ABSTRACT

A multi-dimensional calendar (10) for indicating the day, date and month. The multi-dimensional calendar (10) includes three disks (28), (30) and (32). The first disk (28) has a circumference and includes indicia indicative of the date printed about a periphery thereof. The second disk (30) has a circumference of a size smaller than the circumference of the first disk (28) and includes indicia indicative of the month printed about a periphery thereof. The third disk (32) has a circumference of a size smaller than the circumference of the second disk (30) and includes indicia indicative of the day printed about a periphery thereof. A platform (12) retains the first, second and third disks (28), (30) and (32) thereon, whereby the second disk (30) is positioned between the first and third disks (28) and (32). A first gear apparatus (64) automatically rotates the first disk (28) a first predetermined distance after expiration of a first predetermined period. A second gear apparatus (68) is connected to the first gear apparatus (64) for automatically rotating the second disk (30) a second predetermined distance after expiration of a second predetermined period equal to a period in which the first disk (28) completes a full rotation. A third gear apparatus (66) automatically rotates the third disk (32) a third predetermined distance after expiration of the first predetermined period. The current day, date and month is indicated on the calendar (10) by a pointer (36) having a window (40) below which the current day, date and month are aligned.

13 Claims, 5 Drawing Sheets

MULTI-DIMENSIONAL CALENDAR

BACKGROUND OF THE INVENTION

1. Field of the Invention

The instant invention relates generally to calendars and, more specifically, to a multi-dimensional calendar.

2. Description of the Prior Art

Numerous calendar devices have been provided in prior art. For example, U.S. Pat. Nos. 241,088; 273,725; 328,768; 734,991; 818,577 and 2,411,185; French Patents numbered FR 1,004,119 and FR 1,129,614 and German Patent number 378,730 are all illustrative of such prior art. While these units may be suitable for the particular purpose to which they address, they would not be as suitable for the purposes of the present invention as heretofore described.

U.S. Pat. No. 241,088

Inventor: Joseph R. Swain

Issued: May 3, 1881

This invention relates to calendars and includes a casing a glass face and a fastening rim. Two disks are secured to the casing one disk having a larger diameter than the other. The larger disk has the names of the month printed around its edge while the smaller disk has the names of the week printed around its edge. An annulus is positioned to cover the larger disk and includes a hole through which one month is visible. The annulus has the numbers 1–31 printed thereon. In use the smaller disk is aligned to match the days of the week with the correct date and the current month is positioned to be viewable through the hole in the annulus.

U.S. Pat. No. 273,725

Inventor: Wilson L. Gorton

Issued: Mar. 13, 1883

This invention relates to a certain means whereby the days of the week and dates of any occurrence in any year within the Christian era may be readily shown. This device contains a plurality of compass wheels each being divided into sections representative of the month, day, date and letters and numbers representing each month.

U.S. Pat. No. 328,768

Inventor: Wallace T. Fenn

Issued: Oct. 30, 1885

This invention relates to the class of calendars called "perpetual" and it consists in the peculiar combination of disks bearing numbers and names, respectively, and so arranged that by the rotation of one or more of the disks the calendar may be set for the current month.

U.S. Pat. No. 734,991

Inventor: Victor Sterki

Issued: Jul. 28, 1903

This invention relates to instruments for reminding persons of business engagements and other events desirable to be borne in mind. It includes a number of disks bolted to a piece of sheet metal, the disks indicating the day, date and time. A number of leaf springs are attached to the piece of sheet metal for holding cards or the like.

U.S. Pat. No. 818,577

Inventor: William B. Summerall

Issued: Apr. 24, 1906

This invention relates generally to perpetual calendars and, more particularly, to one of that class embodying a plurality of superimposed disks bearing the names of the days of the week, days of the month, months of the year, and the years of the century, and has for its object to improve the manner in connecting such disks whereby their manipulation in setting the calendar will be materially facilitated.

U.S. Pat. No. 2411,185

Inventor: Louis Bernstein

Issued: Nov. 19, 1946

This invention proposes a perpetual calendar which is characterized by a support sheet having an opening for viewing a year plate. It is proposed to movably mount the year behind said support sheet so that each year it may be turned to a new position and display the number of the year through the opening in said support sheet.

French Patent Number 1,004,119

Inventor: Winocour

Issued: Mar. 26, 1952

This patent discloses a device which may be placed on a watch band. It includes three discs of differing size positioned in size order one above the other, the smallest disk on top. The disks are secured by a bolt extending therethrough. Each disk includes one of the days of the week, months of the year and numbers 1–31, representative of the date, printed thereon and includes a cover including a recess such that only one day, month and number can be seen through their respective recess. Each cover includes an opening in its side for manually changing the day, month and date.

French Patent Number 1,129,614

Inventor: M. Fabien Carli

Issued: Jan. 23, 1957

This patent describes a device including three differently sized wheels positioned in size order one above the other and connected through their midpoint by a bolt. The smallest wheel includes the days of the week printed around the outer periphery thereof, the middle wheel has the numbers 1–31 representative of the date printed thereon and the bottom largest wheel has the months of the year printed around the outer periphery thereon. The wheels are manually operated to identify the current day, date and month which are aligned under an arrow.

German Patent Number 378,730

Inventor: Richard Erlemann

Issued: Aug. 10, 1921

This patent describes a device including three wheels. The largest wheel includes the months printed around its outer periphery and the numbers 29, 30 and 31 therebelow based upon the number of days in the month. A cover allows a single month and the relevant numbers to show therethrough. A second wheel includes the numbers 1–28 placed thereon, the relevant additional numbers on the first disk are viewable following the number 28 based upon the current month. A third wheel has the days of the week printed around its outer periphery is rotatably positioned to match with each particular date. An arrow is rotatably connected to point to the actual day and manually adjusted each subsequent day and date of the identified month.

SUMMARY OF THE INVENTION

The present invention is concerned with calendars and, more specifically, to a multi-dimensional calendar including pivotable disks for identifying the present day, date and month.

A primary object of the present invention is to provide a multi-dimensional calendar which will overcome the shortcomings of the prior art devices.

Another object is to provide a multi-dimensional calendar which is simple and easy to use.

A further object is to provide a multi-dimensional calendar which is economical in cost to manufacture.

A still further object is to provide a multi-dimensional calendar which is automated to automatically rotate the disks and thereby monitor the current day, date and month.

A yet further object of the present invention is to provide a multi-dimensional calendar which includes a stand for mounting the calendar.

A still further object of the present invention is to provide a multi-dimensional calendar which includes an analog or digital clock for displaying the time.

An additional object is to provide a multi-dimensional calendar which is perpetual in nature and therefor useful without regards to changing years, decades or centuries.

An even further object is to provide a multi-dimensional calendar which is decorative and can be fashioned to fit the decor of any area.

A multi-dimensional calendar for indicating the day, date and month is disclosed by the present invention. The multi-dimensional calendar includes three disks. The first disk has a circumference and includes indicia indicative of the date printed about a periphery thereof. The second disk has a circumference of a size smaller than the circumference of the first disk and includes indicia indicative of the month printed about a periphery thereof. The third disk has a circumference of a size smaller than the circumference of the second disk and includes indicia indicative of the day printed about a periphery thereof. A platform retains the first, second and third disks thereon, whereby the second disk is positioned between the first and third disks. A first gear apparatus automatically rotates the first disk a first predetermined distance after expiration of a first predetermined period. A second gear apparatus is connected to the first gear apparatus for automatically rotating the second disk a second predetermined distance after expiration of a second predetermined period equal to a period in which the first disk completes a full rotation. A third gear apparatus automatically rotates the third disk a third predetermined distance after expiration of a third predetermined period equal to the first predetermined period. The current day, date and month is indicated on the calendar by a pointer having a window below which the current day, date and month are aligned.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMBERS

Figure 1:
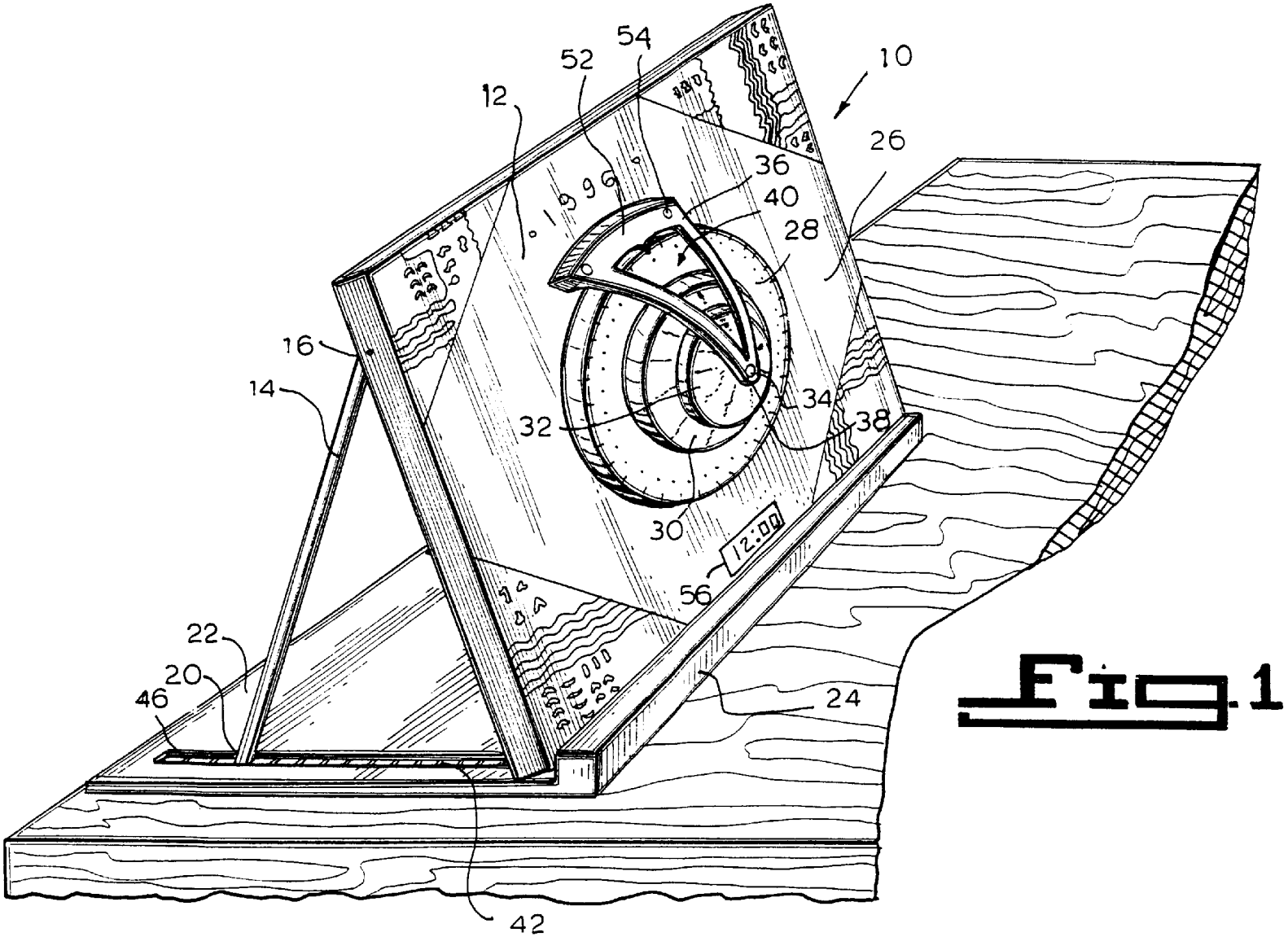
FIG. 1 is a perspective front view of the multi-dimensional calendar of the present invention positioned on a flat surface.

Turning now descriptively to the drawings, in which similar reference characters denote similar elements throughout the several views, the figures illustrate a multi-dimensional calendar of the present invention. With regard to the reference numerals used, the following numbering is used throughout the various drawing figures.

10 the multi-dimensional calendar of the present invention
12 face
14 stand pole
16 first end of stand pole
18 back side of face plate
20 second end of stand pole
22 base
22 base
24 stop block
26 front side of face plate
28 first disk (date)
29 first pivot
30 second disk (month)
31 second pivot
32 third disk (day)
33 third pivot

34 bolt
36 date indicator
36 date indicator
38 first end of date indicator
40 window
42 first recess in base
44 second recess in base
46 detents
48 first recess in face plate
50 second recess in face plate
52 second end of date indicator
54 bolts
56 clock
56 clock
58 automation mechanism
60 power supply
62 oscillator
64 gear mechanism for turning first disk
66 gear mechanism for turning second disk
68 gear mechanism for turning third disk

DETAILED DESCRIPTION OF THE PREFERRED EMBODIMENTS

Turning now descriptively to the drawings, in which similar reference characters denote similar elements throughout the several views, the figures illustrate a multi-dimensional calendar. The multi-dimensional calendar is indicated generally by the numeral 10.

The multi-dimensional calendar 10 will now be described with reference to FIGS. 1–8 and includes a face plate 12 which is propped into a standing position by stand poles 14 pivotally connected at a first end 16 to a back side 18 of the face plate 12, as is illustrated in FIG. 1. A second end 20 of the stand poles 14 is slideably connected to a base 22. The base 22 includes a stop block 24 connected to a front edge thereof for mating with a bottom edge of the face plate 12 to form an even block when the face plate 12 is not in an upright standing position.

It is to be understood that the face plate 12 in accordance with the present invention can be formed of any suitable material such as wood, ceramic, enamel, lucite, plastic, steel, metal, any alloy thereof or any combination of materials and the like and that the invention is not intended to be limited by the materials from which the face plate is formed.

Figure 5:
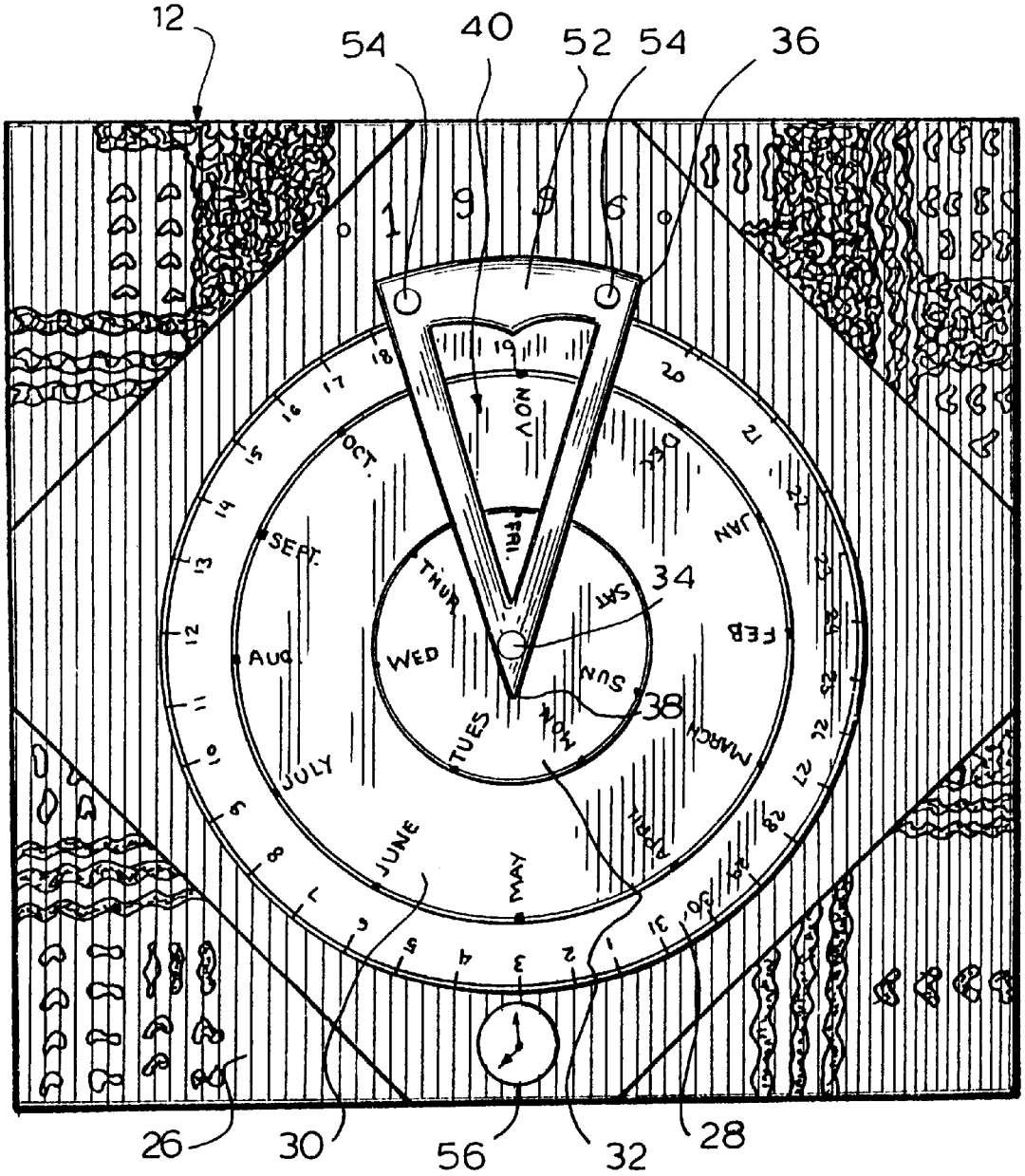
FIG. 5 is a front view of the multi-dimensional calendar of the present invention.

The front side 26 of the face plate 12 is illustrated in FIG. 5 and includes a first pivotable disk 28 divided into thirty-one (31) equally sized wedges, the numbers 1–31 are each printed on an outer periphery of the first disk 28 in a respective one of the wedges. The numbers are indicative of the date. A second pivotable disk 30 is connected above the first disk 28. The circumference of the second disk 30 is smaller than the first disk 28 whereby the numbers printed on the outer periphery of the first disk 28 are visible when the second disk 30 is positioned on top of the first disk 28. The second disk 30 is divided into twelve (12) evenly sized wedges, a respective month of the year is printed within each wedge. A third disk 32 is positioned adjacent the second disk 30, sandwiching the second disk 30 between the first and third disks 28 and 32, respectively. The third disk 32 is divided into seven (7) equally sized wedges, each wedge including a respective one of the days of the week printed therein. The circumference of the third disk 32 is smaller than that of the second disk 30 whereby the months printed on the second disk 30 are visible when the third disk 32 is printed on top of the second disk 30.

It is to be realized that the first, second and third disks are interchangeable whereby the divisions and indicia indicated above for each disk is for purposes of example only and not meant to be limiting. For example, the first disk may be divided into seven evenly sized wedges to identify the days of the week while the second disk may be divided into thirty-one evenly sized wedges identifying the date and the third disk may be divided into twelve evenly sized wedges identifying the months of the year.

Figure 7:
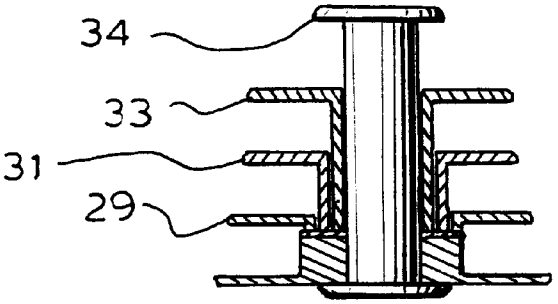
FIG. 7 is a side cross-sectional view of the disk pivots and rivet of the multi-dimensional calendar of the present invention.
Figure 6:
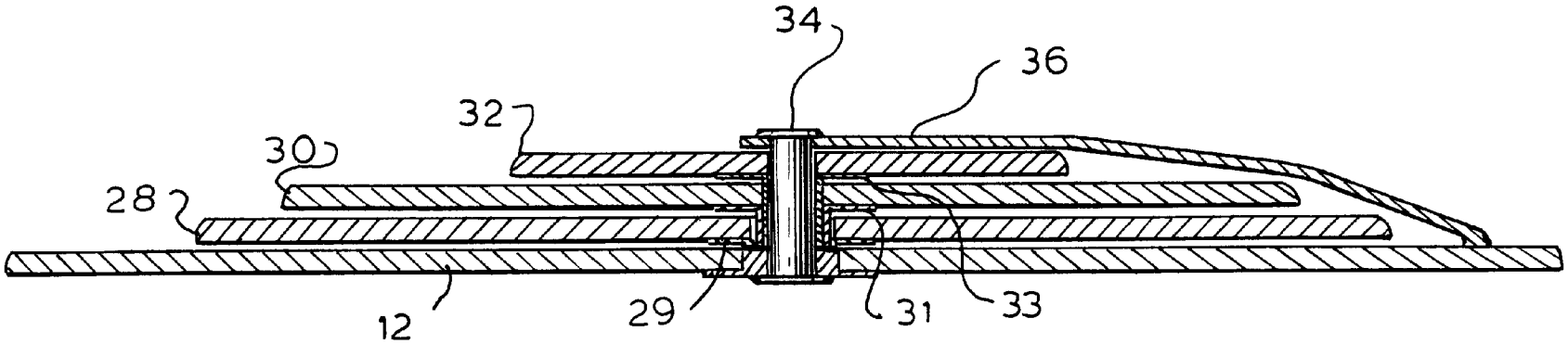
FIG. 6 is a side cross-sectional view of the multi-dimensional calendar of the present invention.
Figure 8:
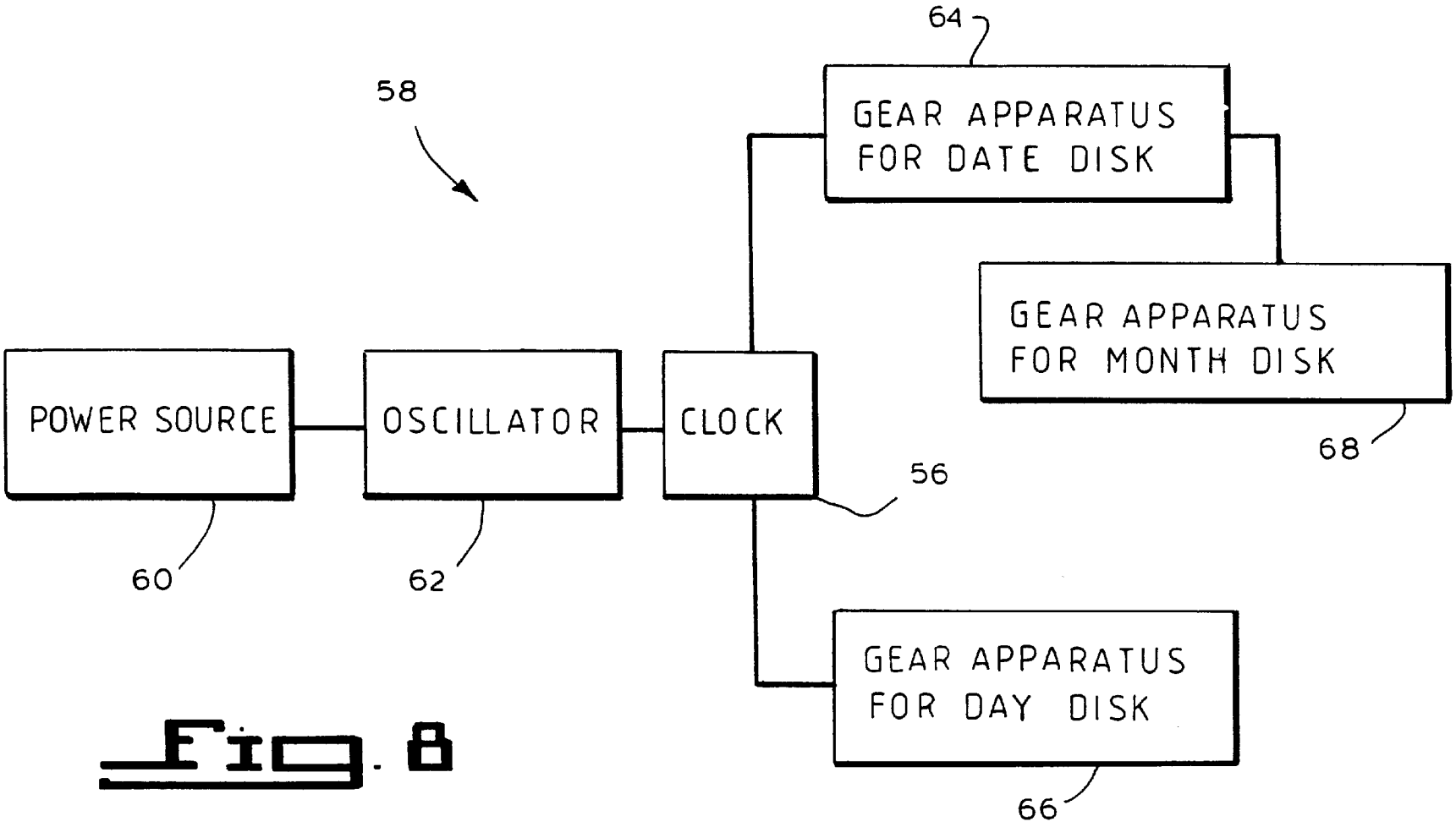
FIG. 8 is a schematic diagram illustrating the automatic gears of the multi-dimensional calendar of the present invention.

The first, second and third disks 28, 30 and 32 are connected to the face plate 12 by a rivet or bolt 34. As can be seen in FIGS. 6 and 7, the first disk 28 is connected to and pivotable about the bolt 34 via a first pivot 29 on which it is positioned. The second disk is likewise connected to and pivotable about the bolt 34 via a second pivot 31 and the third disk 32 is connected to and pivotable about the bolt 34 via a third pivot 33. The first, second and third pivots 29, 31 and 33 are separated from one another and act to separate the first, second and third disks 28, 30 and 32 thereby allowing the disks to rotate independently of one another.

A date indicator or pointer 36 is fastened to the face plate 12 and extends over the first, second and third disks 28, 30 and 32. The date indicator 36 is fastened at a first end 38 to the first, second and third disks 28, 30 and 32 by the bolt 34 and includes a window 40 allowing the present set date, month and day to be viewed therethrough. A second end 52 of the date indicator 36 is fastened to the front side 26 of the face plate 12 by bolts 54. Also positioned on the front side of the face plate 12 is a clock 56. The clock 56 may be digital or analog and is viewable when looking at the calendar 10. The front side 26 of the face plate 12 can also be decorated in any manner desirable to fit the decor of any environment in which it is to be placed.

Figure 2:
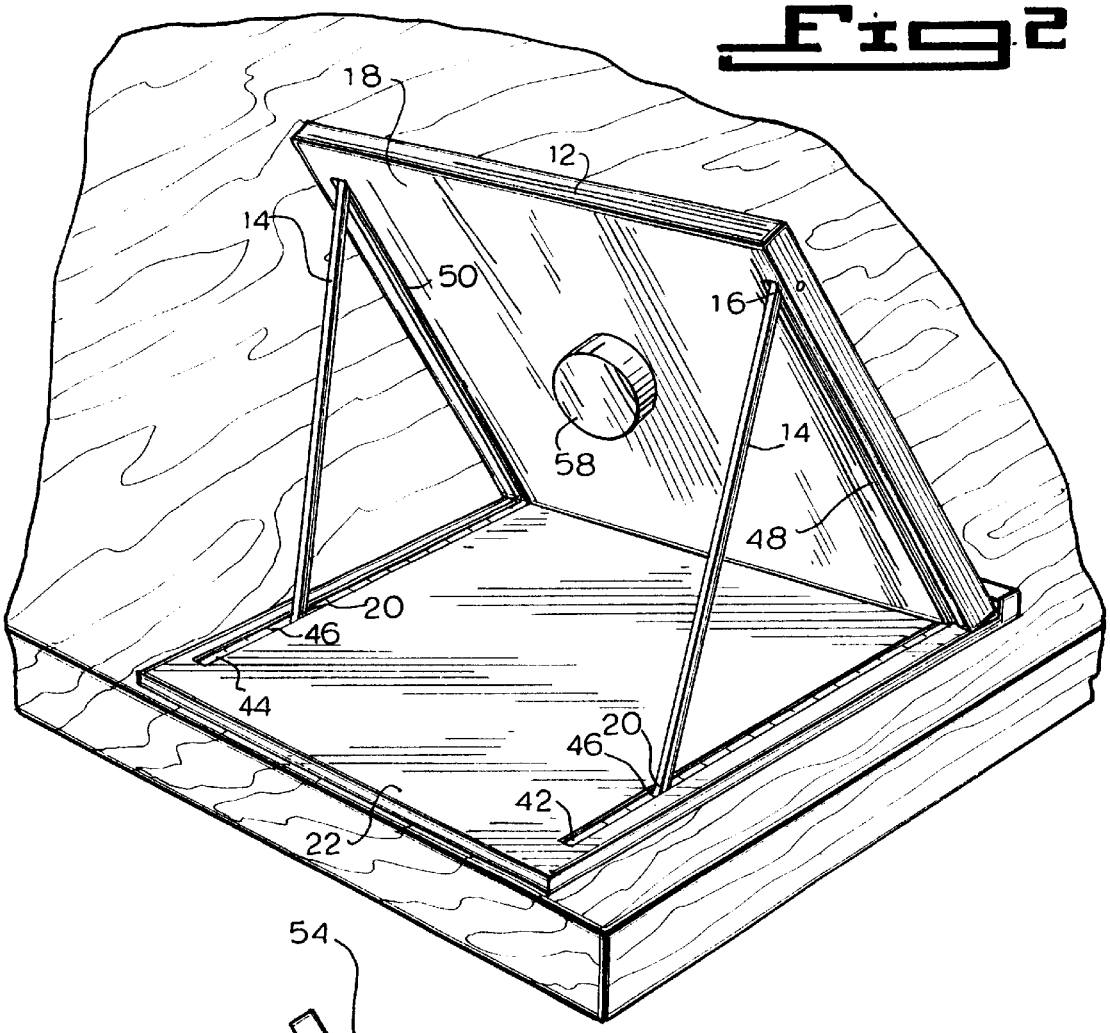
FIG. 2 is a perspective back view of the multi-dimensional calendar of the present invention positioned on a flat surface.
Figure 4:
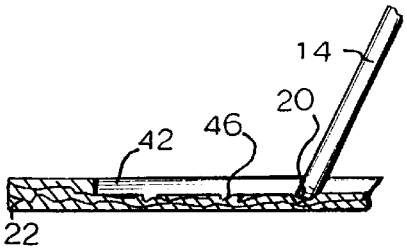
FIG. 4 is a cross-sectional view of the stand of the multi-dimensional calendar of the present invention positioned on a flat surface.

The base 22 includes first and second recesses 42 and 44 for accommodating the stand poles 14 when the face plate 12 is not in an upright position and providing a track along which the stand poles 14 may move as is illustrated in FIGS. 2 and 4. A plurality of detents 46 extend within each recess 42 and 44 perpendicular to the length of the recesses 42 and 44. The back side 18 of the face plate 12 also includes first and second recesses 48 and 50 for accommodating the stand poles 14 when not in an upright position.

Figure 3:
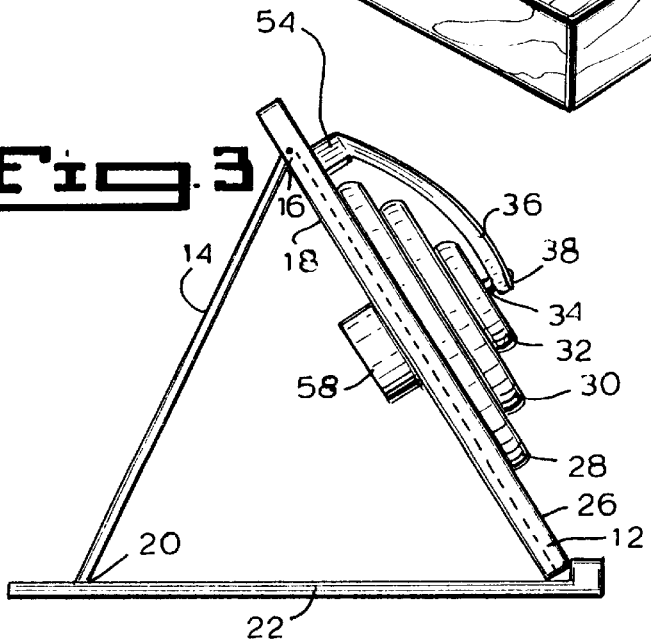
FIG. 3 is a side view of the multi-dimensional calendar of the present invention positioned on a flat surface.

The automatic gear circuit 58 for turning the first, second and third disks 28, 30 and 32 to correctly indicate the day, date and month are illustrated as protruding from the back side 18 of the face plate 12 in FIGS. 2 and 3. The internal components of the automatic gear circuit 58 are more clearly seen in the schematic diagram of FIG. 8. The automatic gear circuit 58 includes a power source 60 such as a battery or the device may include a power cord for connection to an electrical outlet In the case of receiving power from an electrical outlet, a voltage regulator must be included for regulating the amount of power supplied to the automatic gear circuit 58. The power source 60 is connected to supply power to an oscillator 62. The oscillator 62 may be in the form of a crystal which oscillates at a synchronous rate able to operate the clock 56. The clock 56 is connected to the gear mechanism 64 for turning the first disk 28 and the gear mechanism 66 for turning the third disk 32. The gear mechanism 64 for turning the first disk 28 is connected to the gear mechanism 68 for turning the second disk 30. The clock 56 is connected to the gear mechanism 64 for rotating the first disk 28 a distance equal to the size of one wedge or $1/31$ of the circumference of the first disk 28 and to the gear mechanism 66 for rotating the third disk 32 a distance equal to one wedge or $1/7$ of the circumference of the third disk 32 during each twenty-four (24) hour period. The gear mechanism 64 is connected to the gear mechanism 68 for rotating the second gear 30. The gears within gear mechanism 64 and gear mechanism 68 co-act to rotate the second disk 30 a distance equal to the size of one wedge or 1/12 of the circumference of the second disk 30 for each complete rotation of the first disk 28.

In operation, the face plate 12 is originally positioned with the back side 18 flush against the base 22 and each of the stand poles 14 positioned within respective aligned recesses 42 and 48, 44 and 50 respectively in the base 14 and face plate 12. The face plate 12 is then lifted from a side opposite the stop block 24 causing the stand poles 14 to slide within their respective recess 42, 44 in the base 22, traveling over the detents 46 therein while pivoting about its top end 16 attached to the back side 18 of the face plate 12. When the face plate 12 is lifted to an appropriate angle, the stand poles 14 are allowed to come to rest in the detent 46 immediately behind its current position.

When power is applied to the calendar 10 by either connecting a battery to the terminals of the oscillator 62 or inserting a plug attached to the oscillator 62 into an electrical outlet, the clock 56 begins to operate and is set to the correct time by either moving the hands in the event an analog clock is positioned on the face plate 12 or using the appropriate controls to set the digital clock positioned on the face plate 12. The first, second and third disks 28, 30 and 32 are then turned manually to position the appropriate day, date and month beneath the window 40 in the date indicator 36.

The power is supplied by the power source 60 to the oscillator 62 to thereby control operation of the clock 56. As the clock 56 operates, it controls a gear mechanism 64 connected to the first disk 28 and a gear mechanism 66 connected to the third disk 32 to rotate. The first disk 28 is connected to complete one full rotation upon completion of thirty-one (31) twenty four hour periods counted by the clock 56 and the third disk 32 is connected to complete one full rotation upon completion of seven (7) twenty four hour periods counted by the clock 56. The gear mechanism 64 is connected to the gear mechanism 68 whereby the second disk 30 is caused to rotate 1/12 of the circumference of the second disk 30 upon completion of one full rotation of the first disk 28. This pattern continues as long as power is applied to the oscillator 62.

When the calendar 10 is operating during a month with less than thirty-one (31) days, when the last day of the month is reached the first disk 28 is rotated manually until the number 1 is positioned within the window 40. The third disk is rotated a distance equal to 1/7 of its circumference if necessary or until the day of the week immediately following the current day is positioned within the window 40.

The present invention is thus able to provide a multi-dimensional calendar that will overcome the shortcomings of the prior art devices, is simple and easy to use and is economical in cost to manufacture. The multi-dimensional calendar is also automated to automatically monitor the current day, includes a stand for mounting the calendar and an analog or digital clock for displaying the time. Furthermore, the multi-dimensional calendar is perpetual in nature to be useful without regards to changing years, decades or centuries and can be fashioned to fit the decor of any area.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multi-dimensional calendar for indicating the day, date, and month, comprising:

a) a first disk having a circumference including indicia positioned about a periphery thereof;

b) a second disk having circumference smaller than said circumference of said first disk including indicia positioned about a periphery thereof;

c) a third disk having a circumference smaller than said circumference of said second disk including indicia positioned about a periphery thereof, one of said disks being divided along its periphery into twelve equal sized wedges each of which indicates a different month, a second of said disks being divided along its periphery into thirty-one equal sized wedges each of which indicates a date, and the third of said disks being divided alone its periphery into seven equal sized wedges each of which indicates a day of the week;

d) stationary platform means for retaining said first, second and third disks for rotation thereon about a common axis, said second disk being positioned between said first and third disks with the peripheries of three disks being visible;

e) first, second and third gear means for driving each of said disks independently of each other for showing on each successive day the month, the date, and the day of the week;

f) said first gear means generating a first rotation signal and automatically rotating said first disk a first predetermined distance after expiration of a first predetermined period;

g) said second gear means connected to said first gear means generating a second rotation signal and automatically rotating said second disk a second predetermined distance after expiration of a second predetermined period;

h) said third gear means generating a third rotation signal and automatically rotating said third disk a third predetermined distance after expiration of a third predetermined period;

i) power means for supplying power to said first, second and third gear means so that the disks having dates and days of the week move one wedge after each day and the disk having the months thereon move one wedge every thirty one days; and j) stationary indicator means mounted on said platform means having a window for viewing the current month, date and day of the week.

2. The multi-dimensional calendar as recited in claim 1, further comprising clock means positioned on said platform means for displaying a time of day.

3. The multi-dimensional calendar as recited in claim 2, wherein said clock means is a digital clock.

4. The multi-dimensional calendar as recited in claim 2, wherein said clock means is an analog clock including first and second hands for displaying the time of day.

5. The multi-dimensional calendar as recited in claim 1, further comprising a base and at least one stand pole connected between said base and platform means, wherein said platform means is adjustable between a first rest position in which said platform means is in a position flush with said base and a second adjustably supported position in which said platform means is retained at an angle of inclination to said base by said at least one stand pole.

6. The multi-dimensional calendar as recited in claim 5, wherein said base includes at least one slot therein for housing said at least one stand pole when said platform means is in said first position.

7. The multi-dimensional calendar as recited in claim 6, wherein said at least one slot includes a plurality of detents therein for receiving said at least one stand pole when said platform means is in said second position, each of said plurality of detents defining a specific angle of inclination for said platform means.

8. The multi-dimensional calendar as recited in claim 7, wherein said platform means further includes a bottom side and said base further includes a front side and a stop block positioned at said front side wherein said stop block mates with said bottom side when said platform means is in said first position and retains said platform means on said base when said platform means is in said second position.

9. The multi-dimensional calendar as recited in claim 1, further comprising a bolt for pivotably connecting said first, second and third disks to said platform means.

10. The multi-dimensional calendar as recited in claim 9, further comprising:

a) first pivot means connected to said first disk for pivoting said first disk about said bolt in response to receipt of said first rotation signal from said first gear means;

b) second pivot means connected to said second disk for separating said second disk from said first disk and pivoting said second disk about said bolt in response to receipt of said second rotation signal from said second gear means; and c) third pivot means connected to said third disk for separating said third disk from said second disk and pivoting said third disk about said bolt in response to receipt of said third rotation signal from said third gear means.

11. The multi-dimensional calendar as recited in claim 1, wherein said first, second and third disks may be manually adjusted and set.

12. The multi-dimensional calendar as recited in claim 1, wherein said platform means is made from one of wood, ceramic, enamel, lucite, plastic, metal, steel, any alloy thereof and any combination thereof.

13. The multi-dimensional calendar as recited in claim 1, wherein said power source is a battery.

* * * * *